US005333749A

United States Patent [19]

Schellenberg

[11] Patent Number: 5,333,749

[45] Date of Patent: Aug. 2, 1994

[54] PACKING CONTAINER

[75] Inventor: Walter Schellenberg, Diepoldsau, Switzerland

[73] Assignee: Rundpack AG, Diepoldsau, Switzerland

[21] Appl. No.: 61,832

[22] Filed: May 13, 1993

[30] Foreign Application Priority Data

May 18, 1992 [CH] Switzerland ..... 01579/92

[51] Int. Cl.[5] ..... B65D 5/56

[52] U.S. Cl. ..... 220/462; 206/512; 220/410; 220/418

[58] Field of Search ..... 220/408, 410, 416, 418, 220/461, 462; 206/509, 512

[56] References Cited

U.S. PATENT DOCUMENTS

| | | | |
|---|---|---|---|
| 2,736,065 | 2/1956 | Wilcox | 220/462 |
| 3,575,358 | 4/1971 | Dilot | 220/462 |
| 3,601,305 | 8/1971 | Benzon-Petersen | 220/461 |
| 3,779,447 | 12/1973 | Bemiss | 220/418 |
| 3,927,821 | 12/1975 | Dunning | 220/462 |
| 3,941,301 | 3/1976 | Jorgensen | 220/461 |
| 4,049,188 | 9/1977 | Persson | 220/461 |
| 4,257,530 | 3/1981 | Faller | 220/418 |
| 4,722,474 | 2/1988 | Dropsy | 220/462 |
| 4,779,758 | 10/1988 | Chazal et al. | 220/462 |
| 4,801,017 | 1/1989 | Artusi | 220/410 |

FOREIGN PATENT DOCUMENTS

| | | | |
|---|---|---|---|
| 238437 | 9/1987 | European Pat. Off. | 220/408 |
| 350943 | 11/1972 | Switzerland . | |
| 1579535 | 11/1980 | United Kingdom | 206/512 |
| 92017375 | 10/1992 | World Int. Prop. O. | 220/410 |

*Primary Examiner*—Gary E. Elkins
*Attorney, Agent, or Firm*—Ladas & Parry

[57] ABSTRACT

The packing container has an outer container shaped from a card blank (7) and an inner container deep drawn from a plastic sheet. The strong, but manually detachable connection between the outer and inner containers of the packing container takes place positively, in that during the deep drawing of the inner container bulges are formed in its wall, which penetrate cutouts (39 to 44) of the outer container. Thus, for separate waste disposal purposes, the outer container can be completely and easily separated again from the inner container.

5 Claims, 1 Drawing Sheet

FIG. 1
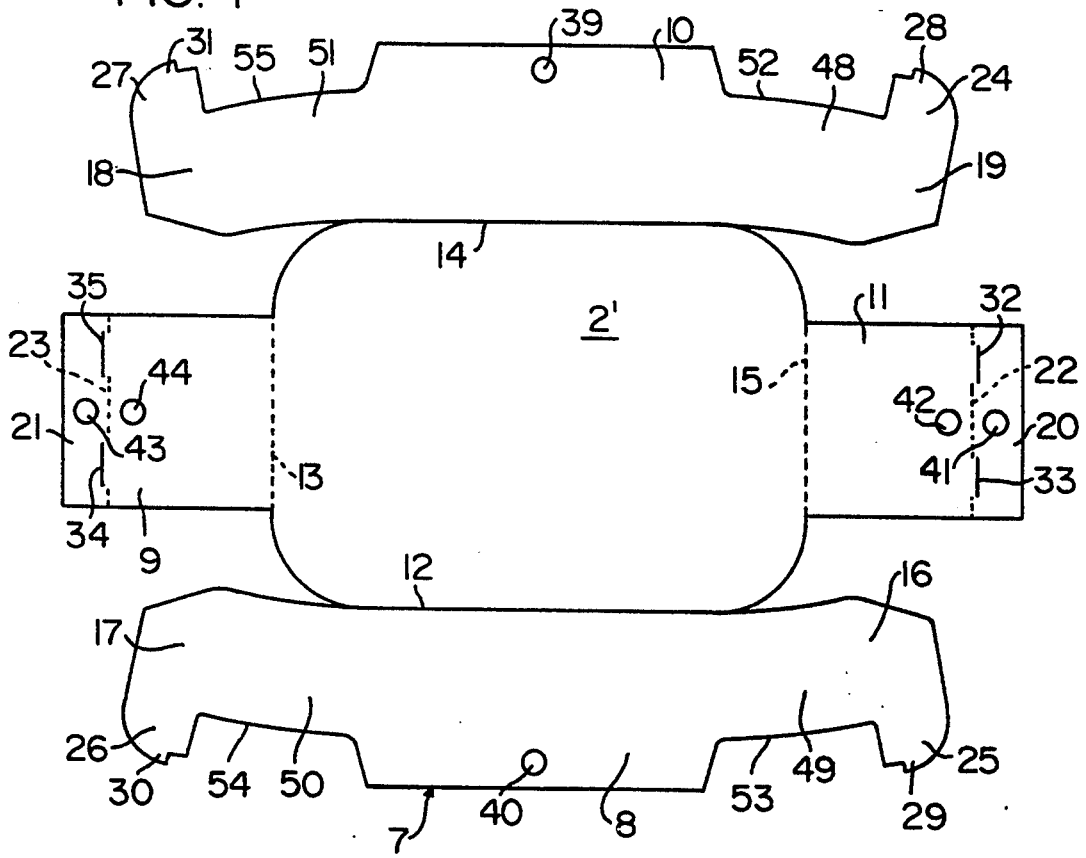
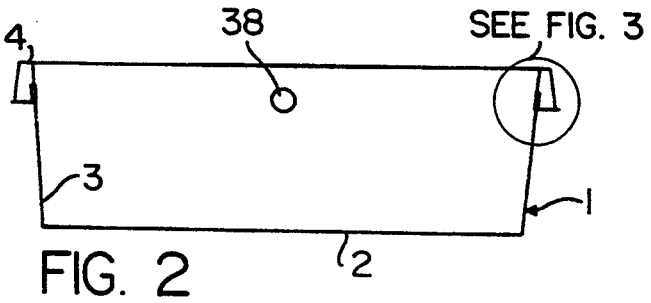
FIG. 2
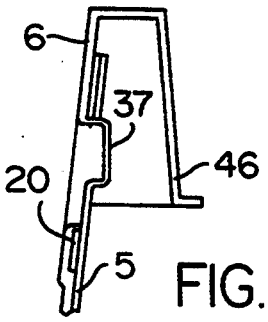
FIG. 3
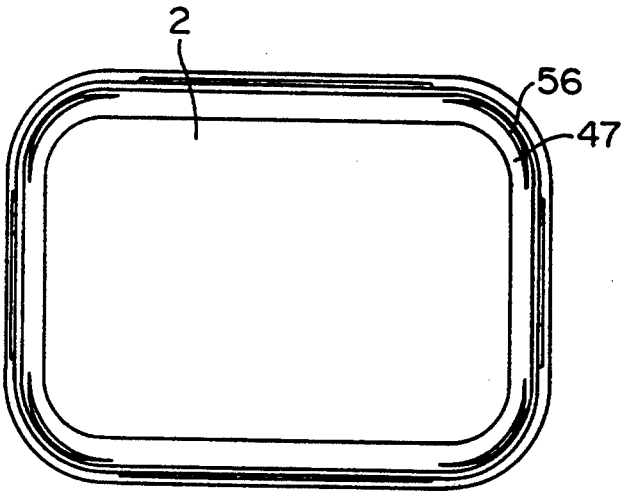
FIG. 4

PACKING CONTAINER

BACKGROUND OF THE INVENTION

The invention relates to a packing container comprising an outer container shaped from a one-piece cardboard blank and an inner container deep drawn from a plastic sheet, the two being shaped onto one another corresponding to a stackable container shape by the deep drawing of the inner container.

A container of this type is at present widely used for the packing of e.g. margarine. The thicker outer cardboard layer has an inner plastic coating and it is bent from a cardboard blank to the container shape, before being combined with the inner layer in the deep drawing mould for the production of the latter. The plastic coating of the outer layer is welded to the heated plastic material of the inner layer and a firm union is formed along the entire surface.

SUMMARY OF THE INVENTION

The problem of the invention is to improve a container of the aforementioned type in such a way that the consumer can easily and without any aids separate the plastic material of the inner layer from the cardboard material of the outer layer, so that the two materials can be separately supplied to waste disposal.

According to the invention this problem is solved in that individual wall cutouts are provided for a detachable connection between the inner container formed by the plastic sheet and the outer container formed from a cardboard blank in the outer container, into which are shaped bulges of the inner container.

The resulting positive connection ensures a reliable union between the outer and inner containers, so as to give a unitary overall container.

The thicker outer layer can be produced in a winding process starting from a strip material or by folding starting from a cardboard blank.

DESCRIPTION OF THE DRAWINGS

The invention is described in greater detail hereinafter relative to a non-limitative embodiment and the attached drawings, wherein show:

FIG. 1 A view of the cardboard blank for the production of the outer container of the packing container.

FIG. 2 A longitudinal section through the packing container.

FIG. 3 The marginal area III of the packing container according to FIG. 2 on a larger scale.

FIG. 4 A plan view of the packing container.

DETAILED DESCRIPTION OF THE PREFERRED EMBODIMENT

The packing container 1 has a flat bottom 2 and four side walls 3, which in slightly outwardly directed manner extend to the opening-side container rim 4, so that, prior to filling, it can be stacked with numerous identical packing containers.

The packing container 1 is provided with its necessary rigidity by a cardboard material outer container 5, whilst its sealing action is ensured by an inner container 6 formed by deep drawing from a thin plastic sheet.

FIG. 1 shows a cardboard blank 7, produced by punching, for the production of the outer container 5 of the packing container. The parts 8 to 11 of the blank are bent upwards along the fold lines 12 to 15, the narrow-side blank parts 9, 11 being outwardly placed over the arcuately inwardly bent ends 16, 17 and 18, 19 of the blank parts 8, 10. In addition, the outer end 20, 21 of the narrow-side blank parts 9, 11 is bent inwards via fold lines 22, 23, so as to enclose upwardly directed end regions 24 to 27 of the blank parts 8, 10 and whose offset tips 28 to 31 engage in short slots 32 to 35, which are located in a line with the fold lines 22, 23. On shaping the plastic sheet forming the inner container 6 in a deep drawing mould and in which has previously been placed the outer container, the plastic sheet engages closely round the outer container 5 and correspondingly the inwardly folded ends 20, 21 of the narrow-side blank parts 9, 11 are firmly engaged on the enclosed, upwardly directed end regions 24 to 27 of the blank parts 8, 10, so that the blank parts 8 to 11 of the outer container 5 are securely interconnected.

During deep drawing a firm, positive connection is achieved between the inner and outer containers 6, 5, in that the bulges 37, 38 of the inner container 6 are shaped into the cutouts 39 to 44 of the outer container, as is apparent from the larger-scale view of FIG. 3. The cutouts 41, 42 and 43, 44 are superimposed after folding, so that they are jointly engaged by a bulge 37. The deep drawing mould is provided at corresponding points with shaping bulges, so that they contribute to the design of the bulges 37, 38 of the inner container 6. Preferably the bulges 37, 38 only follow the upper contour of the circular cutouts 39 to 44, so that they are covered by the hollow edge 46 of the inner container 6 drawn outwards and downwards over the outer container 5. This leads to a firm union between the inner and outer containers 6, 5, so that the in itself unstable inner container 6 is reinforced by the outer container 5 so as to provide a stable overall container. Hitherto this has only been achievable by a bond between the two and the parts 8, 10 of the cardboard blank with the other parts 9, 11 thereof. It is particularly advantageous in connection with the set problem of the invention that by avoiding an adhesive, following the use of the packing container, it is possible in simple manner to bring about a separate waste disposal of the cardboard component and the plastic component of said packing container. In order to facilitate the necessary tearing away of the outer container 5 from the inner container 6, on the outer container 5 can be shaped not shown predetermined parting lines and/or gripping tabs.

The tabs 48 to 51 of the blank parts 8, 10 forming the arcuate comer regions 47 of the outer container 5 have larger recesses 52 to 55, into which can be shaped shoulder-forming bulges 56 of the inner container 6, so that they extend in crescent-shaped manner around the upper region of the arcuate comer regions 47. These shoulder-forming bulges 56 serve as stacking shoulders, which in the case of stacked, empty packing containers 1, are supported on the opening-side container rim 4 of the underlying packing container 1. This prevents a jamming of the stacked packing containers 1, so that they can easily be detached from one another before being supplied to a filling station. In addition, the edge of the recesses 52 to 55 parallel to the opening rim 4 of the packing container 1 is supported on said stacking shoulders, so that the positive fixing of the outer container 5 to the inner container 6 is improved.

An air-tight closure of the packing container can be brought about in that a not shown closure film is sealed onto the container rim 4. In addition, a lid can be provided and engages over the hollow edge 46.

What is claimed is:

1. A packing container comprising:

an outer container shaped from a one-piece cardboard blank, the outer container having a bottom part and four side parts which are bent away from the bottom part and form side walls of the container, the bottom part being defined by linear bending edges, and the side walls running linearly up to rounded transition areas;

an inner container deep drawn from a plastic sheet, the inner and outer containers stackable with respect to each other;

individual wall cutouts providing for a detachable connection between the inner container and the outer container, the cutouts being formed near an outer edge of the side parts;

bulges shaped into the inner container; and a cross-sectionally U-shaped marginal area defined by the inner container passing outwards from an opening rim and extending over the bulges of the inner container.

2. A packing container according to claim 1, wherein the wall cutouts are larger than the bulges, the bulges being closely embraced by the wall cutouts directed toward the rim.

3. A packing container according to claim 1, wherein an outer end of two facing side parts of the cardboard blank are bent inwards by means of fold lines, so that the outer ends enclose end regions of the other two side parts of the cardboard blank.

4. A packing container according to claim 3, wherein two slots are provided in a line corresponding with the fold lines in two of the side parts, in which are locked hooked tips of the end regions of the other two side parts.

5. A packing container according to claim 1, with the rounded transition areas being arcuate corner regions, wherein the outer container is provided with upwardly open recesses in corner regions thereof, the recesses receiving stacking shoulders of the inner container following the shape of the arcuate corner regions, the stacking shoulders being supported on an edge of the recesses parallel to the opening rim of the packing container.

* * * * *